US008191264B2

(12) United States Patent
Veenstra et al.

(10) Patent No.: US 8,191,264 B2
(45) Date of Patent: Jun. 5, 2012

(54) SHAVING APPARATUS

(75) Inventors: Geert Veenstra, Drachten (NL); Sieds Bosch, Drachten (NL); Leonardus Hendrikus Gerardus Johannes Segeren, Drachten (NL); Sjoerd Haites, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 417 days.

(21) Appl. No.: 11/630,299

(22) PCT Filed: Jun. 10, 2005

(86) PCT No.: PCT/IB2005/051923

§ 371 (c)(1),
(2), (4) Date: Dec. 19, 2006

(87) PCT Pub. No.: WO2006/000937

PCT Pub. Date: Jan. 5, 2006

(65) Prior Publication Data

US 2008/0016690 A1 Jan. 24, 2008

(51) Int. Cl.
*B26B 19/14* (2006.01)

(52) U.S. Cl. ..... 30/43.6; 30/346.51

(58) Field of Classification Search ..... 30/41.6, 30/43.4, 43.6, 41.1, 43.2, 43.1, 43.5, 346.51
See application file for complete search history.

(56) References Cited

U.S. PATENT DOCUMENTS

| | | | | | |
|---|---|---|---|---|---|
| 3,447,241 | A * | 6/1969 | Moeckl | 30/41 |
| 3,636,626 | A * | 1/1972 | Zuurveen | 30/43.5 |
| 3,740,843 | A * | 6/1973 | Tietjens | 30/43.6 |
| 3,813,774 | A * | 6/1974 | Cobarg | 30/43.9 |
| 3,844,033 | A * | 10/1974 | Yonkers | 30/43.5 |
| 3,858,316 | A * | 1/1975 | Tietjens | 30/43.6 |
| 3,913,225 | A * | 10/1975 | Tietjens et al. | 30/43.6 |
| 4,192,065 | A * | 3/1980 | Tietjens | 30/43.6 |
| 4,549,352 | A * | 10/1985 | Ochiai et al. | 30/41.5 |
| 4,663,842 | A * | 5/1987 | Bosch | 30/43.6 |
| 4,675,998 | A * | 6/1987 | Thijsse | 30/43.6 |
| 6,219,920 | B1 | 4/2001 | Klein | |
| 6,581,289 | B2 * | 6/2003 | Nakano | 30/43.6 |
| 7,370,420 | B2 * | 5/2008 | Shimizu | 30/43.4 |
| 2004/0163258 | A1 * | 8/2004 | Uchiyama | 30/43.2 |
| 2005/0223559 | A1 * | 10/2005 | Stevens | 30/34.2 |
| 2005/0257376 | A1 * | 11/2005 | De Wit et al. | 30/43.4 |

FOREIGN PATENT DOCUMENTS

| | | | |
|---|---|---|---|
| DE | 20 19 746 | | 11/1971 |
| EP | 1 452 281 | | 9/2004 |
| WO | WO 03/011537 | | 2/2003 |
| WO | WO2004/012914 | * | 2/2004 |

* cited by examiner

*Primary Examiner* — Laura M. Lee

(57) ABSTRACT

Shaving apparatus having at least one cutting unit with an external cutting member and a movable internal cutting member. An energy-dissipating system is provided between mutually movable parts of the internal or an external cutting member to reduce the bouncing effect between the internal and external cutting member after cutting a hair. Such an energy-dissipating system may for example be an element with visco-elastic properties.

15 Claims, 5 Drawing Sheets

SHAVING APPARATUS

Figure 1:
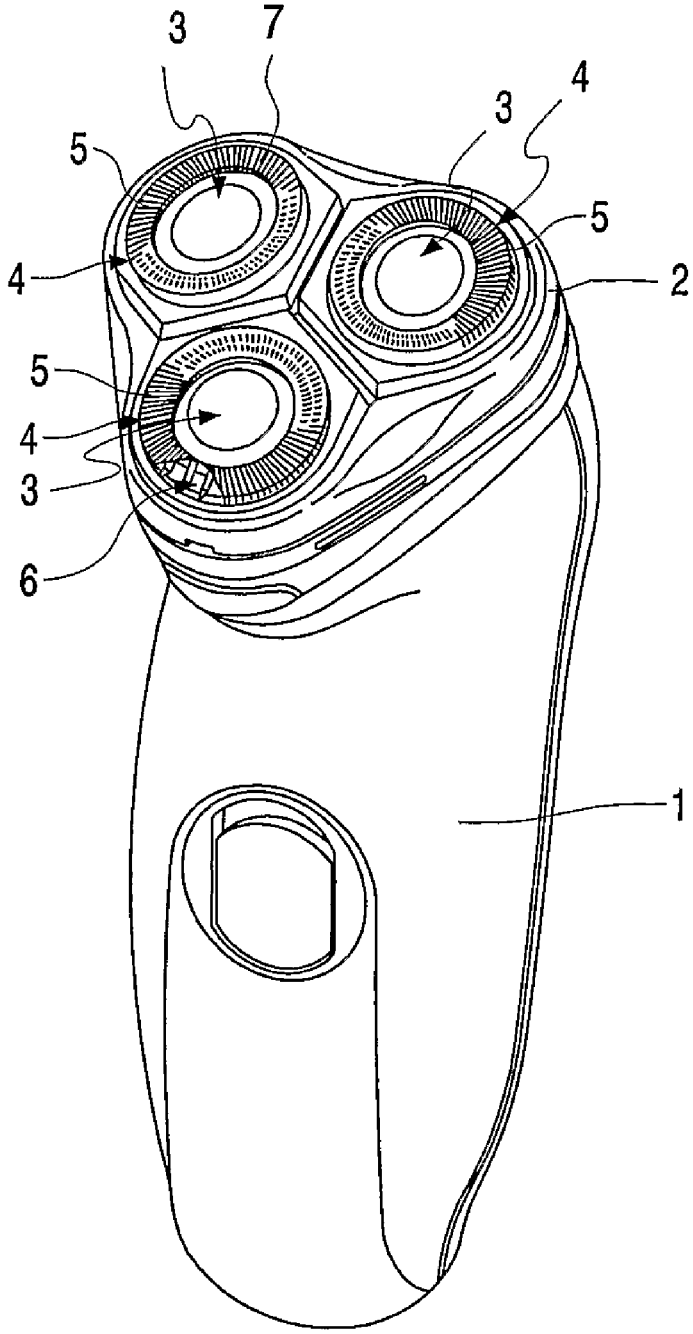

The invention relates to a shaving apparatus having a housing and at least one cutting unit which comprises an external cutting member and an internal cutting member that can be driven with respect to the former, said external cutting member being provided with hair trap openings bounded by cutting edges, said internal cutting member having cutting elements whose ends are provided with cutting edges for cooperating with the cutting edges of the external cutting member for the purpose of cutting hairs, said shaving apparatus further comprising a drive member for driving the internal cutting member and resilient means for exerting a force on the internal cutting member in the direction of the external cutting member.

The invention also relates to a cutting unit for use in the above shaving apparatus.

Such a shaving apparatus is known from WO 03/011537 (PHNL010514). A cutting gap which is as small as possible must be present between the cooperating cutting edges of the internal and external cutting members if hairs are to be cut satisfactorily. This has been realized in practice until now in that the drive member for driving the internal cutting member is also made resilient in the direction of the external cutting member. As a result, the internal cutting member bears on the external cutting member under a certain bias tension, i.e. the cutting edges of the internal cutting member are pressed against the cutting edges of the external cutting member with a certain force. The cutting gap is accordingly effectively zero. This is necessary because the internal cutting member is decelerated during cutting of a hair, and the occurring cutting forces have a direction that tends to press the cooperating cutting edges somewhat apart, which could lead to too wide a cutting gap. The resilient force of the drive member serves to prevent the gap between the cutting edges from becoming too wide during severing of a hair. As a result, the contact pressure between the internal and external cutting members is small during cutting of a hair, and the friction will be low. The velocity of the occurring cutting forces will nevertheless force the internal cutting member away from the external cutting member immediately after severing of a hair. The internal cutting member will subsequently be pushed back towards the external cutting member by the axial spring pressure of the drive member. The internal cutting member then hits against the inner side of the external cutting member. The internal cutting member then bounces off the external cutting member again, and another cutting gap arises, though smaller than the first one. Then the internal cutting member comes back again. The internal cutting member thus bounces a few times on the external cutting member until the cutting edges remain in contact with one another. This does take only approximately 0.5 ms, but a new hair is cut again during that period. In addition, the cutting elements are rigidly connected to one another in most shaving apparatuses, with the result that also the other cutting elements, or at least a proportion thereof, exhibit this bouncing behavior. It operates in fact as a decaying vibratory mass spring system. It would be best if the cooperating cutting edges were to make contact with one another again immediately after severing of a hair and would remain against one another, i.e. no bouncing effect occurs. The cutting system is then optimally prepared for cutting the next hair. This would be achieved if the bias tension were chosen to be much greater. In periods in which no hairs are cut, however, the bias tension force causes a comparatively high contact pressure between the cooperating cutting members, and accordingly a comparatively strong friction. Hairs are actually cut in less than 10% of the total shaving time during a normal shaving operation. The cutting edges lie against one another under the resilient force in the remaining time. This causes a friction during a major portion of the time which does not only lead to wear of the cutting edges, but also costs much energy. This means for rechargeable shaving apparatuses that the batteries have to be charged more often. Rechargeable batteries also have a finite life span, and after some time it will no longer be possible to charge the batteries satisfactorily, and they will have to be replaced. The apparatus becomes more energy-efficient if there is less friction between the cutting members.

It is an object of the invention to improve the cutting process in a shaving apparatus as described in the opening paragraph.

The invention is for this purpose characterized in that an energy-dissipating system is present between the mutually moving mass parts of the internal cutting member or the external cutting member.

The energy-dissipating system intensifies the decay or damping of the movement of the internal cutting member after severing of a hair. In other words, the internal cutting member comes to a standstill much more quickly, i.e. the cooperating cutting edges come to lie against one another more quickly and permanently after severing of a hair than is the case without an energy-dissipating system. A further advantage is that the bias tension with which the internal cutting member presses against the external cutting member may be chosen to be smaller, which makes the friction losses lower. The frictional torque becomes lower. This has the result for rechargeable shaving apparatuses that the number of shaving minutes of fully charged batteries is greater, heat generation is less, and wear of the cutting edges is less (longer operational life).

A preferred embodiment of the shaving apparatus according to the invention is characterized in that the internal cutting member is provided with a disc from which the cutting elements are formed, which disc is fastened on a carrier, the internal cutting member is further provided with a backing plate which is situated at the opposite side of the cutting elements with respect to the carrier, while the energy-dissipating system is present between the carrier and the backing plate. The disc with cutting elements, the carrier, and the coupling piece may be regarded as one unit of mass components of the internal cutting member, while the backing plate may be regarded as the other mass component of the internal cutting member. The energy-dissipating system is thus connected at one side to the assembly of mass components and at the other side to the mass component formed by the backing plate.

Another preferred embodiment is characterized in that the internal cutting member is provided with a disc from which the cutting elements are formed and with a backing plate which is situated at the opposite side of the cutting elements with respect to the disc, the energy-dissipating system being present between the disc and the backing plate. The disc with cutting elements and the coupling piece now form the one mass component, while the backing plate forms the other mass component.

If the cutting elements are flexible elements, it is also possible to provide energy-dissipating material on the cutting elements themselves.

Bouncing of the internal cutting member with respect to the external cutting member can also be reduced in an embodiment in which the external cutting member is provided with a backing plate, and the energy-dissipating system is located between the external cutting member and the backing plate. The external cutting member and the backing plate then constitute the mutually moving mass components between which the energy-dissipating system is present.

The energy-dissipating system is preferably formed by an element of a visco-elastic material. Materials with visco-elastic properties are, for example, polyborosiloxanes and bitumen.

A preferred embodiment of the shaving apparatus according to the invention is characterized in that the internal cutting member can be driven into rotation, and the damping means are formed by an annular element.

Another possibility is that the energy-dissipating system comprises a friction damper with at least one resilient element connected in parallel thereto.

The invention further relates to a cutting unit comprising an external cutting member and an internal cutting member that can be driven with respect to the former, said external cutting member being provided with hair trap openings bounded by cutting edges, said internal cutting member having cutting elements whose ends are provided with cutting edges for cooperating with the cutting edges of the external cutting member for the purpose of cutting hairs, characterized in that an energy-dissipating system is present between the mutually moving mass parts of the internal cutting member or the external cutting member.

Figure 2:
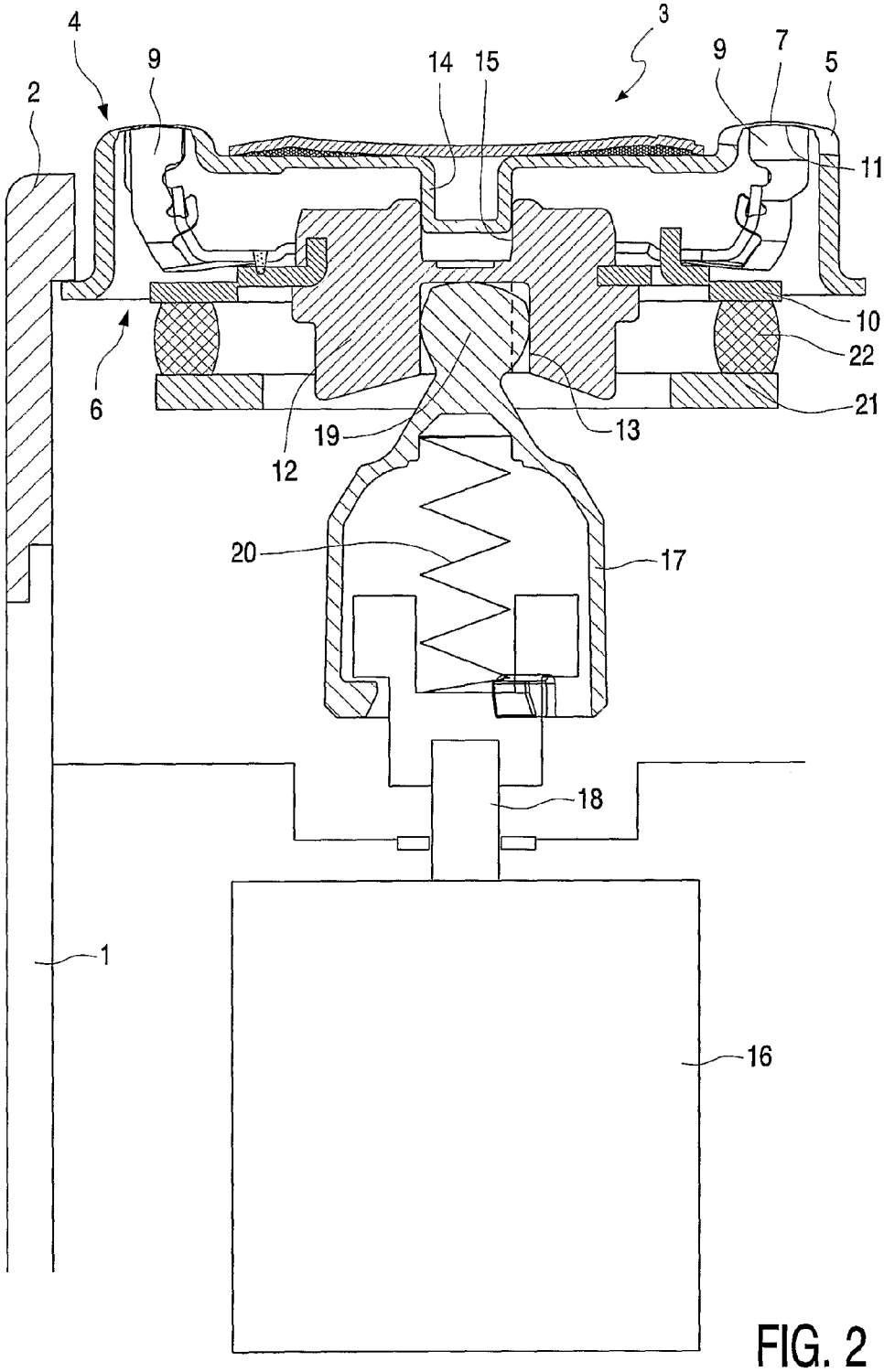
Figure 3:
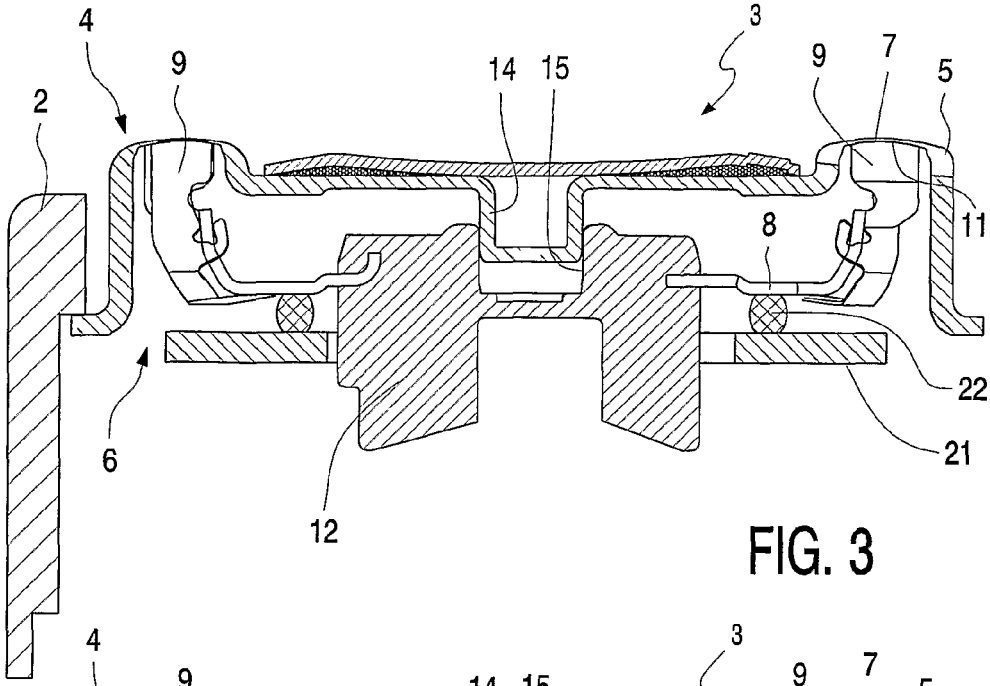
Figure 4:
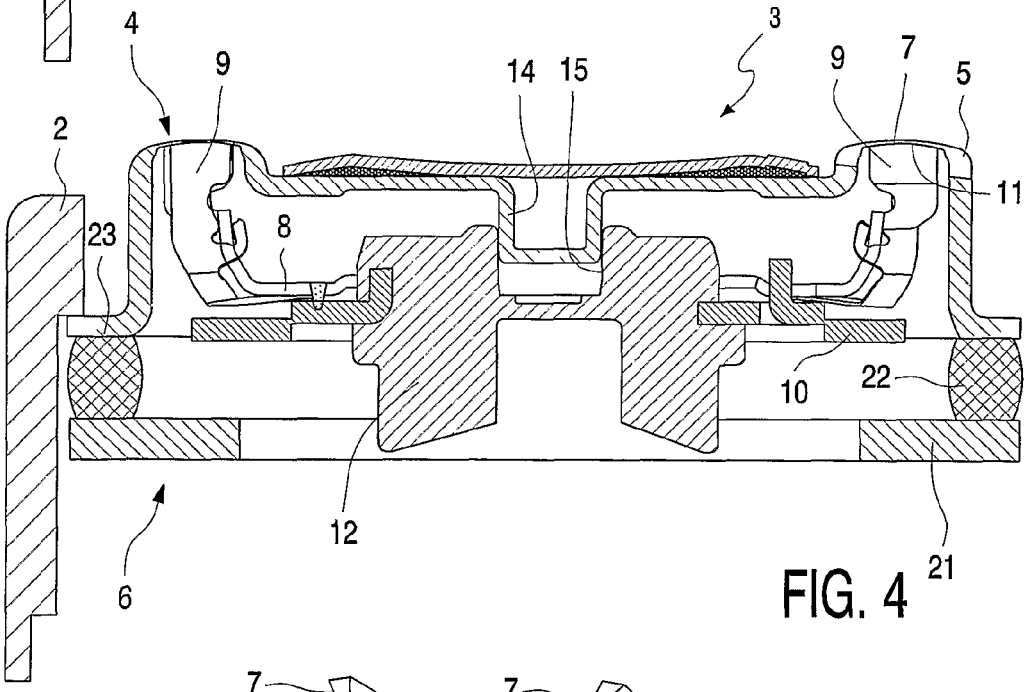
Figure 5:
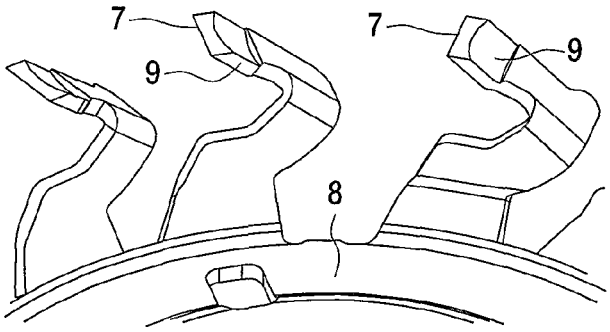
Figure 6:
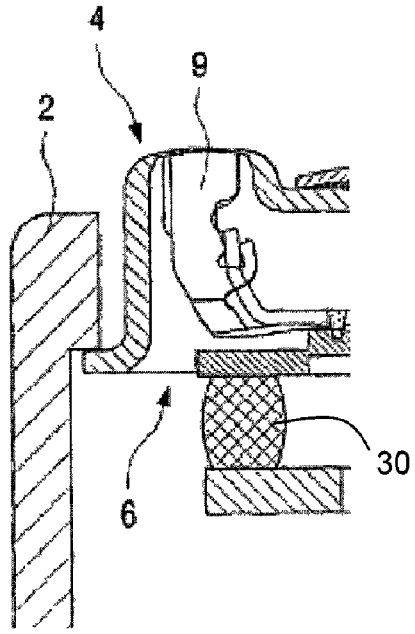
Figure 7:
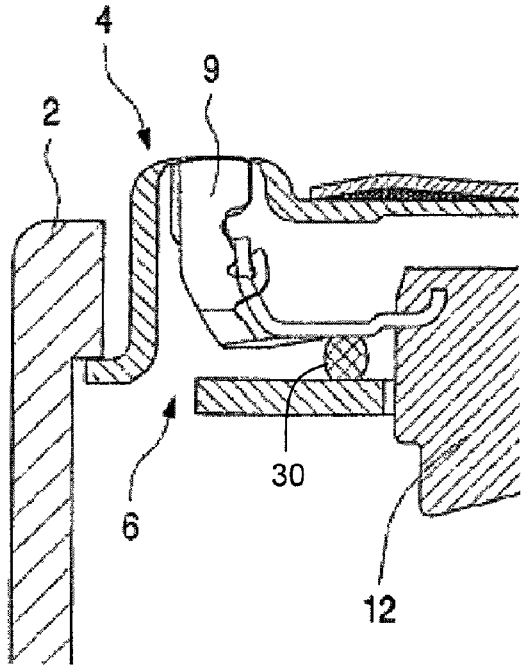
Figure 8:
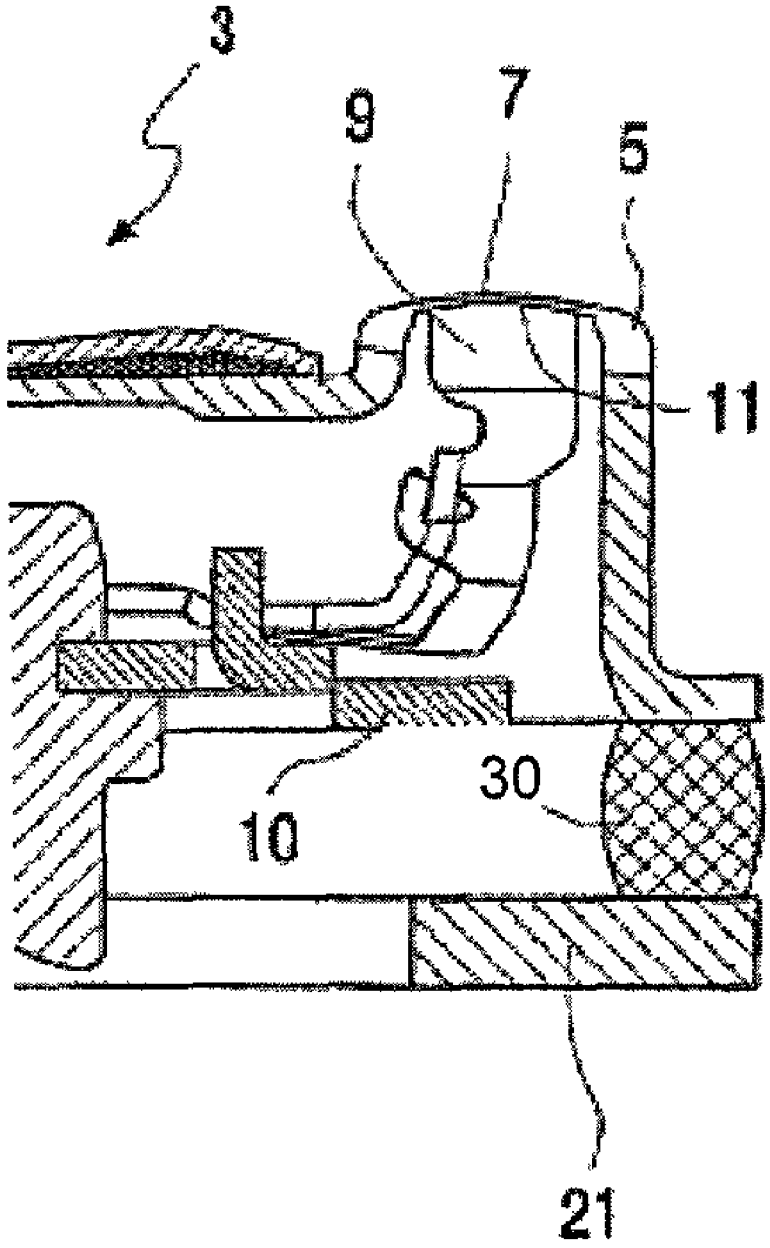

The invention will now be explained in more detail with reference to an embodiment of a rotary driven shaving apparatus shown in the drawing, in which:

FIG. 1 is a perspective view of a shaving apparatus with three cutting units, FIG. 2 is a cross-sectional view of a cutting unit of FIG. 1 in a first embodiment, FIG. 3 is a cross-sectional view of a cutting unit of FIG. 1 in a second embodiment, FIG. 4 is a cross-sectional view of a cutting unit of FIG. 1 in a third embodiment, FIG. 5 shows a fourth embodiment of the invention, FIG. 6 is a cross-sectional view of a portion of a cutting unit of FIG. 2, FIG. 7 is a cross-sectional view of a portion of a cutting init of FIG. 3, FIG. 8 is a cross-sectional view of a portion of a cutting unit of FIG. 4.

Corresponding components have been given the same reference numerals in the description of the embodiments below.

The shaving apparatus of FIG. 1 has a housing 1 with a holder 2 that can be removed from the housing or pivoted with respect thereto. Three cutting units 3, also denoted shaving heads, are present in the holder.

FIG. 2 shows one of the cutting units 3 formed by an external cutting member 4 and an internal cutting member 6 cooperating therewith. The external cutting member 4 has the shape of a circular cap with a rim of hair trap openings 5. The hair trap openings are bounded by walls provided with cutting edges 7. The internal cutting member 6 comprises a disc 8 from which a number of cutting elements 9 are formed. The disc 8 is fastened on a carrier 10. The ends of the cutting elements 9 are provided with respective cutting edges 11 for cooperation with the cutting edges 7 of the external cutting member 4. A coupling piece 12 is fastened in the central portion of the carrier 10 and is provided with a coupling opening 13 at its lower side. The carrier 10 and the coupling piece 12 may be separate components, or they may alternatively be integrally manufactured. The internal cutting member 6 has its central bearing in the external cutting member 4. For this purpose, the external cutting member 4 has a central bearing shaft 14 in the form of a projection of the circular cap, and the coupling piece 12 has a bearing opening 15 at its upper side in which the bearing shaft 14 fits. The internal cutting member 6 is driven into rotation by a motor 16. A drive member 17 is coupled to the motor shaft 18. The drive member 17 has the shape of a hollow coupling pin that can be coupled to the coupling piece 12. For this purpose, the coupling pin has a coupling head 19 which projects into the coupling opening 13 of the coupling piece 12. The coupling pin is provided on the motor shaft 18 so as to be resilient in axial direction. To achieve this, a spring 20 is tensioned between the coupling pin and the motor shaft, pressing the internal cutting member 6 with a certain bias tension in the direction of the external cutting member 4. The cutting edges 11 of the cutting elements 9 of the internal cutting member 6 thus lie under pretension against the cutting edges 7 of the external cutting member 4. The internal cutting member 6 is further provided with an annular backing plate 21 which is located at the opposite side of the cutting elements 9 with respect to the carrier 10. Between the backing plate 21 (in fact a mass plate) and the carrier 10 there is an energy-dissipating system in the form of an annular element 22 of a material that has damping properties. The disc 8 with cutting elements 9, the carrier 10, and the coupling piece 12 may be regarded as one assembly of mass components of the internal cutting member 4, while the backing plate 21 may be regarded as the other mass component of the internal cutting member. The energy-dissipating system (element 22) is thus connected at one side to the assembly of mass components (8, 9, 10, 12) and at the other side to the mass component formed by the backing plate 21.

In the example of FIG. 3, the energy-dissipating system 22 is located between the disc 8 with cutting elements 9 and the backing plate 21. The disc 8 with cutting elements 9 and the coupling piece 12 now form the one mass component, while the backing plate 21 forms the other mass component.

In the example of FIG. 4, the external cutting member is provided with a backing plate 21. The energy-dissipating system 22 is provided between a lower rim 23 of the cap-shaped external cutting member 4 and the backing plate 21. The external cutting member and the backing plate now form the mutually moving mass components between which the energy-dissipating system is present.

The example of FIG. 5 is a detailed drawing of the cutting elements 9 of the internal cutting member 6. If the cutting elements are constructed as flexible elements, it is also possible to provide an energy-dissipating material on the cutting elements themselves, more in particular in those locations where a bending of the cutting element occurs during hair cutting, as shown in the Figure. This also achieves a damping of the internal cutting member after severing of a hair.

The damping material used may be, for example, a visco-elastic material such as polyborosiloxanes or bitumen.

An energy-dissipating system may alternatively be formed by a friction damper with at least one resilient element 30 connected in parallel thereto as shown in FIGS. 6, 7 and 8.

It will be obvious that the invention is not limited to shaving apparatuses of the rotary type as described in the embodiments, but that the invention may equally well be used in shavers with an internal cutting member that is reciprocally driven.

The invention claimed is:

1. A shaving apparatus comprising:

a housing;

a drive member; and at least one cutting unit including:

an external cutting member provided with hair trap openings bounded by cutting edges;

an internal cutting member including a backing plate, a coupling member positioned at a center of the external and internal cutting members for coupling to the drive member, and a mass component having cutting elements provided with cutting edges for cooperating with the cutting edges of the external cutting member for cutting hairs, the drive member driving the internal cutting member with respect to the external cutting member;

resilient means for exerting a force on the internal cutting member in the direction of the external cutting member; and an energy-dissipating system including a plurality of elements positioned outside the coupling member between the backing plate and the mass component of the internal cutting member or the external cutting member, the energy-dissipating system is arranged to dampen movement between any portion of the internal cutting member and the external cutting member after severing of a hair to restore a gap between the internal cutting member and the external cutting member.

2. The shaving apparatus as claimed in claim 1, wherein the mass component includes a carrier and a disc from which the cutting elements are formed, the disc is fastened on the carrier and the backing plate is located at an opposite side of the cutting elements with respect to the carrier, the energy-dissipating system is positioned between the carrier and the backing plate.

3. The shaving apparatus as claimed in claim 1, wherein the cutting elements are flexible elements on which a motion-dissipating material is provided.

4. The shaving apparatus as claimed in claim 1, wherein the energy-dissipating system is formed by an element of a visco-elastic material.

5. The shaving apparatus as claimed in claim 1, wherein the energy-dissipating system comprises a friction damper with a resilient element connected in parallel thereto.

6. The shaving apparatus as claimed in claim 4, wherein the internal cutting member can be driven into rotation, and the element of visco-elastic material is an annular element.

7. A cutting unit comprising;

an external cutting member including hair trap openings bounded by cutting edges;

an internal cutting member driven with respect to the external cutting member the internal cutting member including:

a backing plate, a coupling member positioned at a center of the external and internal cutting members for coupling to the drive member, and a mass component having cutting elements provided with cutting edges for cooperating with the cutting edges of the external cutting member for cutting hairs;

a spring for exerting a force on the internal cutting member in the direction of the external cutting member;

a backing plate; and an energy-dissipating system including a plurality of elements positioned outside the coupling member between the backing plate and the mass component of the internal cutting member or the external cutting member, the energy-dissipating system is arranged to dampen movement between any portion of the internal cutting member and the external cutting member after severing of a hair to restore a gap between the internal cutting member and the external cutting member.

8. The cutting unit as claimed in claim 7, wherein the mass component a carrier and a disc form which the cutting elements are formed, the disc is fastened on the carrier and the backing plate is located at the opposite side of the cutting elements with respect to the carrier, the energy-dissipating system is positioned between the carrier and the backing plate.

9. The shaving apparatus as claimed in claim 3, wherein the motion-dissipating material is a visco-elastic material.

10. The shaving apparatus as claimed in claim 9, wherein the visco-elastic material is one of a polyborosiloxane material or a bitumen material.

11. The cutting unit as claimed in claim 7, wherein the cutting elements are flexible elements on which a motion-dissipating material is provided.

12. The cutting unit as claimed in claim 11, wherein the motion-dissipating material is a visco-elastic material.

13. The cutting unit as claimed in claim 12, wherein the visco-elastic material is one of a polyborosiloxane material or a bitumen material.

14. The shaving apparatus as claimed in claim 1, wherein the energy-dissipating system is annularly shaped.

15. The cutting unit as claimed in claim 7, wherein the energy-dissipating system is annularly shaped.

* * * * *